US011205856B2

(12) United States Patent
Crockett, Jr. et al.

(10) Patent No.: US 11,205,856 B2
(45) Date of Patent: Dec. 21, 2021

(54) COMPACT LONG SLOT ANTENNA

(71) Applicant: RAYTHEON COMPANY, Waltham, MA (US)

(72) Inventors: John A. Crockett, Jr., Anaheim, CA (US); James A. Carr, Fountain Valley, CA (US); Larry C. Martin, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 45 days.

(21) Appl. No.: 16/828,837

(22) Filed: Mar. 24, 2020

(65) Prior Publication Data

US 2021/0044027 A1 Feb. 11, 2021

Related U.S. Application Data

(60) Provisional application No. 62/885,157, filed on Aug. 9, 2019.

(51) Int. Cl.
*H01Q 21/00* (2006.01)

(52) U.S. Cl.
CPC ..... *H01Q 21/0087* (2013.01); *H01Q 21/0075* (2013.01)

(58) Field of Classification Search
CPC ..... H01Q 21/0087; H01Q 21/0075; H01Q 21/064; H01Q 13/22; H01P 1/387
See application file for complete search history.

(56) References Cited

U.S. PATENT DOCUMENTS

| | | | |
|---|---|---|---|
| 6,388,631 | B1 | 5/2002 | Livingston et al. |
| 6,611,180 | B1 | 8/2003 | Puzella et al. |
| 6,653,984 | B2 | 11/2003 | Park et al. |
| 7,298,235 | B2 | 11/2007 | Hauhe et al. |
| 7,315,288 | B2 | 1/2008 | Livingston et al. |
| 7,348,932 | B1 | 3/2008 | Puzella et al. |
| 7,545,322 | B2 | 6/2009 | Newberg et al. |
| 7,907,030 | B2 | 3/2011 | Vaughn et al. |
| 8,279,131 | B2 | 10/2012 | Puzella et al. |
| 8,717,243 | B2 | 5/2014 | Yaccarino et al. |
| 8,981,869 | B2 | 3/2015 | Puzella et al. |
| 9,172,145 | B2 | 10/2015 | Puzella et al. |
| 9,685,707 | B2 | 6/2017 | Crockett, Jr. et al. |

(Continued)

OTHER PUBLICATIONS

International Search Report for corresponding International Application No. PCT/US2020/044333, filed Jul. 30, 2020, International Search Report dated Oct. 8, 2020 and dated Oct. 19, 2020 (4 pgs.).

(Continued)

*Primary Examiner* — Daniel D Chang
(74) *Attorney, Agent, or Firm* — Lewis Roca Rothgerber Christie LLP

(57) ABSTRACT

An array antenna. In some embodiments, the array antenna includes a base plate having a surface including a plurality of grooves, a plurality of circulator carriers on the base plate, a plurality of cover strips on the circulator carriers, a plurality of circulators, and a plurality of threaded fasteners. The circulator carriers and the cover strips may be secured to the base plate by the threaded fasteners. Each of the circulators may be coplanar with the base plate. Materials in the array antenna may be selected to avoid galvanic corrosion.

20 Claims, 8 Drawing Sheets

(56) References Cited

U.S. PATENT DOCUMENTS

| | | | | |
|---|---|---|---|---|
| 9,876,283 | B2 | 1/2018 | Crockett, Jr. et al. | |
| 9,974,159 | B2 | 5/2018 | Puzella et al. | |
| 10,116,064 | B2 | 10/2018 | Hu et al. | |
| 2008/0074324 | A1 | 3/2008 | Puzella et al. | |
| 2012/0068906 | A1 | 3/2012 | Asher et al. | |
| 2013/0176186 | A1* | 7/2013 | Yaccarino ..... | H01Q 13/10 343/787 |
| 2015/0372394 | A1* | 12/2015 | Crockett, Jr. ..... | H01Q 3/24 343/700 MS |

OTHER PUBLICATIONS

Written Opinion of the International Searching Authority for corresponding International Application No. PCT/US2020/044333, filed Jul. 30, 2020, Written Opinion of the International Searching Authority dated Oct. 19, 2020 (7 pgs.).

* cited by examiner

COMPACT LONG SLOT ANTENNA

CROSS-REFERENCE TO RELATED APPLICATION(S)

This application claims priority to and the benefit of U.S. Provisional Application No. 62/885,157, filed Aug. 9, 2019, entitled "COMPACT LONG SLOT ANTENNA", the entire contents of which are incorporated herein by reference. This application is related to and incorporates by reference in its entirety, as if set forth in full, U.S. Pat. No. 8,717,243, entitled "LOW PROFILE CAVITY BACKED LONG SLOT ARRAY ANTENNA WITH INTEGRATED CIRCULATORS".

FIELD

One or more aspects of embodiments according to the present invention relate to antennas, and more particularly to an improved array antenna.

BACKGROUND

An active electronically scanned array (AESA) antenna is an antenna comprising multiple radiators, or elements, the relative amplitude and phase of which can be controlled, making it possible to steer the transmit or receive beam without moving the antenna. Such an antenna includes an aperture for transmitting or receiving waves traveling in free space, and it may include back-end circuitry, including electronics modules for generating signals to be transmitted and for processing received signals. Each element within the aperture may incorporate, or be connected to, a circulator, which passively separates the signals corresponding to transmit and receive channels, and which is connected to a transmit channel and a receive channel in the back-end electronics.

Related art array antennas may have various shortcomings, including high cost of manufacture, difficulty effecting repairs of stripped threads in threaded holes in the antenna, and difficulty effecting repairs of the radome, or wide-angle impedance matching (WAIM) sheet that may cover the aperture. Thus, there is a need for an improved array antenna design.

SUMMARY

According to an embodiment of the present invention, there is provided an array antenna, including: a base plate having a surface including a plurality of channels, a plurality of circulator carriers on the base plate, a plurality of cover strips on the circulator carriers, a plurality of circulators on the circulator carriers, and a plurality of threaded fasteners, the circulator carriers and the cover strips being secured to the base plate by the threaded fasteners, each of the circulators being coplanar with the base plate, the base plate having a first surface in conductive contact with a first surface of a first circulator carrier of the circulator carriers, the first surface of the base plate being composed of a first material having a first anodic index, the first surface of the first circulator carrier being composed of a second material having a second anodic index, the first anodic index and the second anodic index differing by no more than 0.15 V.

In some embodiments: a first cover strip of the plurality of cover strips has a first surface in conductive contact with a second surface of the first circulator carrier; the second surface of the first circulator carrier is composed of a third material having a third anodic index; the first surface of the first cover strip is composed of a fourth material having a fourth anodic index; and the third anodic index and the fourth anodic index differ by no more than 0.15 V.

In some embodiments, the first material, the second material, the third material, and the fourth material are the same.

In some embodiments, the circulator carriers include at least 85% titanium, by weight.

In some embodiments, the first circulator carrier includes an outer surface plating, the outer surface plating being composed of aluminum or gold.

In some embodiments, the base plate is composed of aluminum, and the first surface of the base plate is composed of chromate conversion coated aluminum.

In some embodiments, the first cover strip is composed of aluminum, and the first surface of the first cover strip is composed of chromate conversion coated aluminum.

In some embodiments, the base plate is composed of 7075 aluminum, and the first cover strip is composed of 6061 aluminum.

In some embodiments, a first circulator of the plurality of circulators is secured to the first circulator carrier with silver conductive epoxy bond.

In some embodiments, the silver conductive epoxy bond is sealed with a polymer conformal coating.

In some embodiments, the first circulator carrier includes: a first outer surface plating on the first surface of the first circulator carrier, the first outer surface plating being composed of nickel; a second outer surface plating on the second surface of the first circulator carrier, the second outer surface plating being composed of nickel; and a third outer surface plating on the remainder of the outer surface of the first circulator carrier, the third outer surface plating being composed of gold. In some embodiments, the base plate is composed of aluminum, and the first surface of the base plate is composed of nickel.

In some embodiments, the first cover strip is composed of aluminum, and the first surface of the first cover strip is composed of nickel.

In some embodiments, each of the threaded fasteners is a stainless steel machine screw with a length of at least 0.300 inches and an outer thread diameter of at most 0.052 inches, and the array antenna is suitable for operation at 18 GHz.

In some embodiments, a first one of the threaded fasteners has a star-socket head with a diameter of at most 0.074 inches, and the star-socket head has a star-shaped socket, the star-shaped socket having a vertical-walled portion and a fallaway portion, the vertical-walled portion having a height of at least 0.010 inches.

In some embodiments, a first one of the threaded fasteners has a shaft having a threaded portion extending along at least one-quarter of the shaft, the threaded portion including thread-locking compound.

In some embodiments, the first circulator carrier has a plurality of notch dams configured to prevent a first epoxy applied at an edge of a cutout from bleeding into a second epoxy applied at the edge of the cutout.

In some embodiments, the base plate includes a plurality of fine alignment pins extending through the first circulator carrier and into a first cover strip of the plurality of cover strips.

In some embodiments, the first cover strip includes a coarse alignment pin extending through the first circulator carrier and into the base plate.

In some embodiments, the array antenna further includes: a translation plate, secured to the bottom of the base plate;

and a printed wiring board, secured to the bottom of the translation plate, the printed wiring board including a plurality of microstrip transmission lines, the translation plate being conductive and having a plurality of channels each corresponding to a respective one of the plurality of microstrip transmission lines.

BRIEF DESCRIPTION OF THE DRAWINGS

Features, aspects, and embodiments are described in conjunction with the attached drawings, in which.

Each drawing is drawn to scale, for one embodiment.

DETAILED DESCRIPTION

The detailed description set forth below in connection with the appended drawings is intended as a description of exemplary embodiments of a compact long slot antenna provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the scope of the invention. As denoted elsewhere herein, like element numbers are intended to indicate like elements or features.

Figure 1:
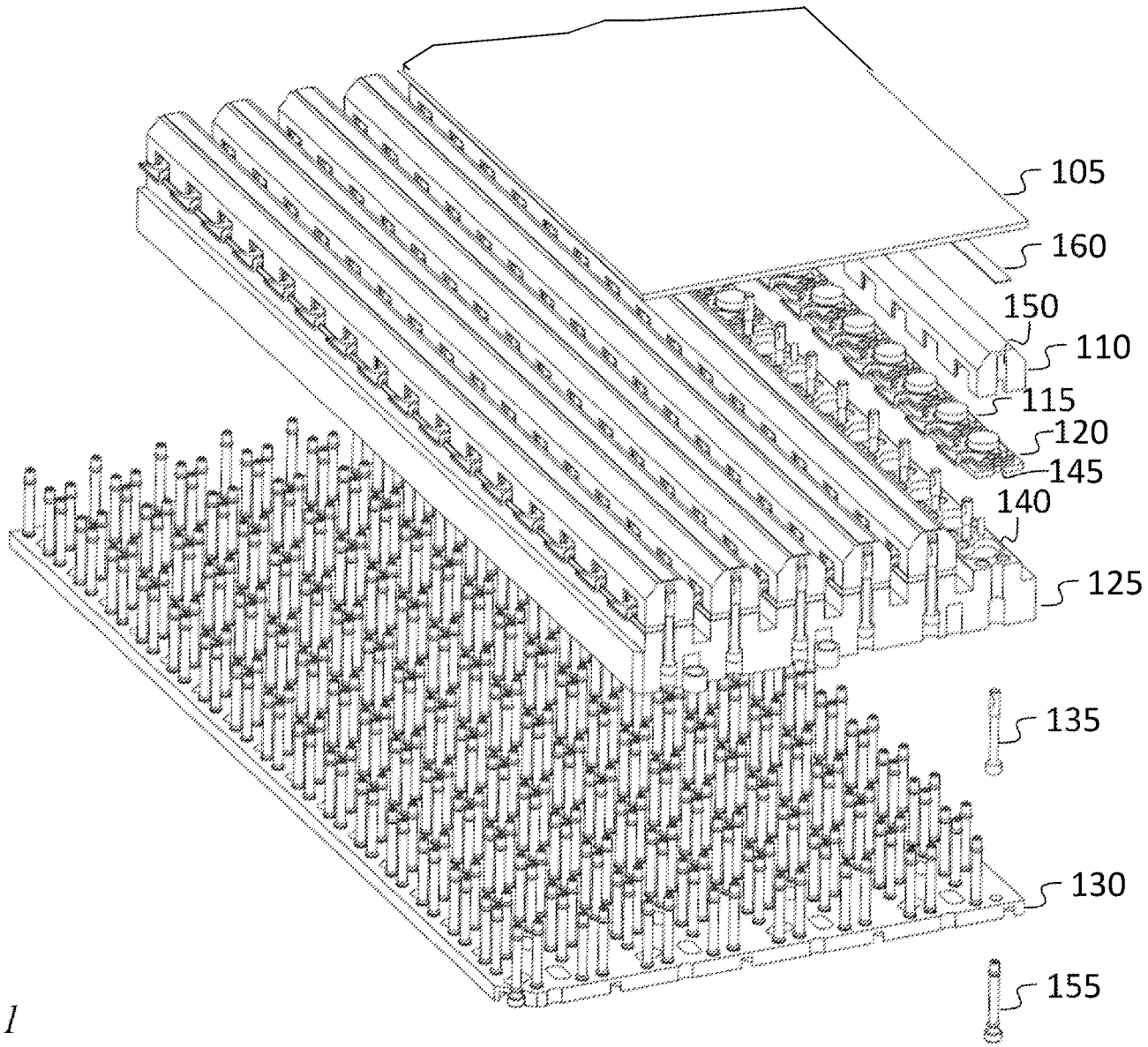
FIG. 1 is an exploded perspective view of a portion of a compact long slot antenna, according to an embodiment of the present invention.

For the purpose of this description, the surface of the antenna from which radiation may emanate will be referred to as the "top" of the antenna. Referring to FIG. 1, a compact long slot antenna may include a wide-angle impedance matching (WAIM) sheet 105, a plurality of conductive cover strips 110, a plurality of circulators 115, secured to conductive circulator carriers 120, a conductive base plate 125, and a conductive translation plate 130. The assembly may be held together by screws 135 installed through counterbored clearance holes 140 in the base plate 125 and clearance holes 145 in the circulator carriers 120, and threaded into threaded holes 150 in the cover strips 110. In FIG. 1, the ends of the cover strips 110 and of the circulator carriers 120 are cut away to make clearance holes 140 in the base plate 125 and clearance holes 145 in the circulator carriers 120 more readily visible.

Each circulator 115 may be a four-port circulator, with a first port connected to an integrated probe 210 (FIGS. 2A and 2D), and with second, third, and fourth ports connected, through respective coaxial interconnects 155, to the translation plate 130. The two ports that are immediately upstream and downstream of the integrated probe 210 may be connected, through a printed wiring board (not shown) below the translation plate 130, to transmit and receive electronics (not shown) which may also be present, in a complete antenna, below the translation plate. The remaining port of each circulator 115 may be connected to a termination resistor on the printed wiring board. The printed wiring board may have microstrip transmission lines that together with corresponding channels in the translation plate 130 form channelized microstrip transmission lines, for connecting the transmit and receive electronics (which may be constructed on a different pitch from that of the circulators 115) to the coaxial interconnects 155 (which may be on the same pitch as the circulators 115). The wide-angle impedance matching sheet 105 may be secured to the tops of the cover strips 110 with a plurality of epoxy preforms 160.

Figure 2B:
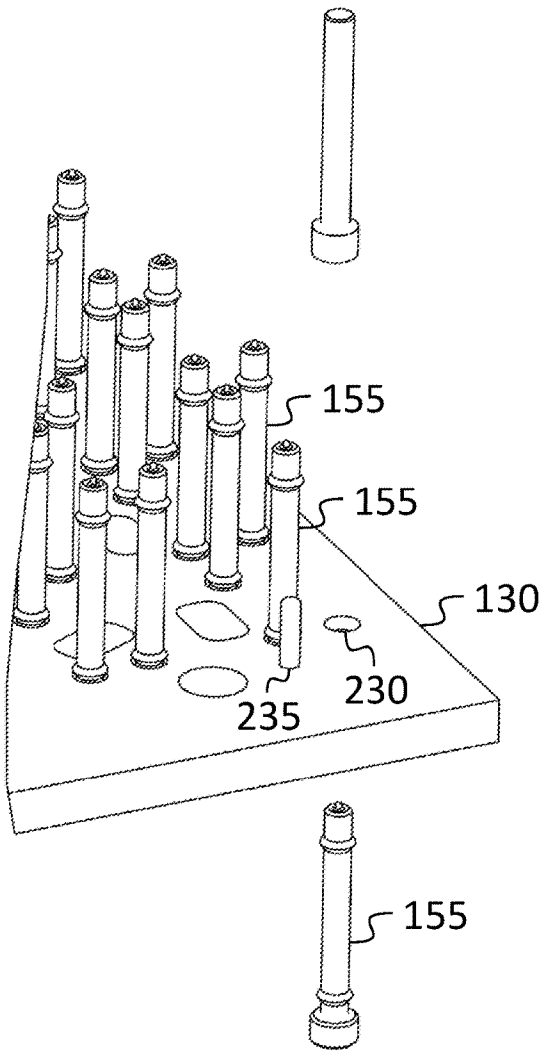
FIG. 2B is an enlarged view of a portion of FIG. 1, according to an embodiment of the present invention.
Figure 2A:
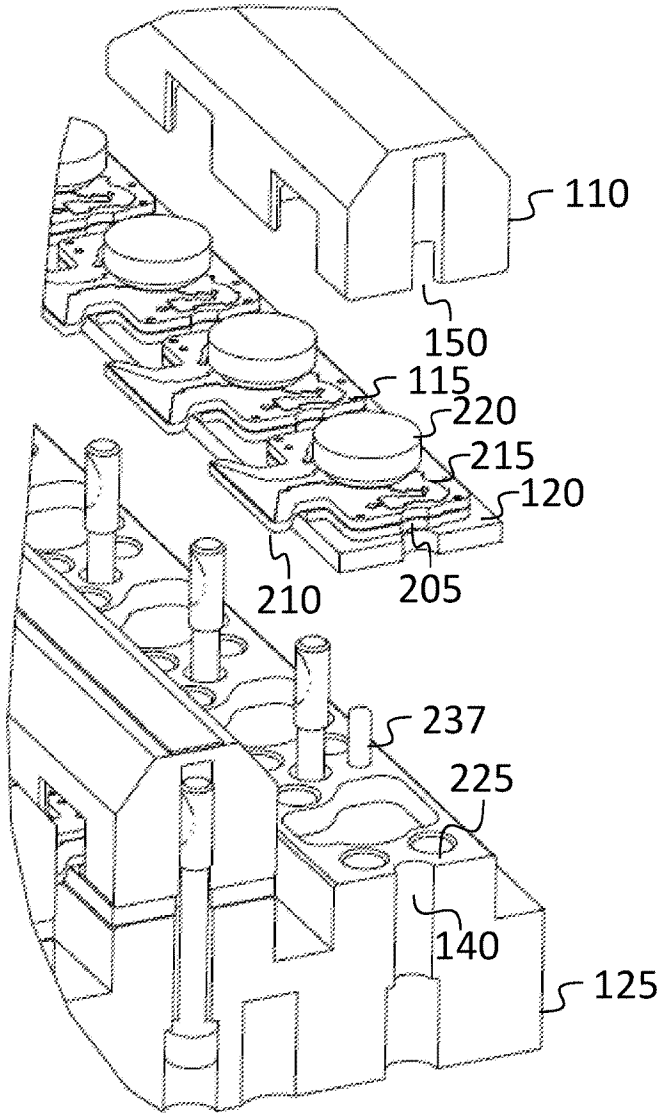
FIG. 2A is an enlarged view of a portion of FIG. 1, according to an embodiment of the present invention.

FIGS. 2A and 2B are enlarged views of respective portions of FIG. 1. Each of the circulators 115 may be "scalloped", i.e., it may have curved cutouts 205 (e.g., cutouts which in a top view have the shape of a circular arc) to provide clearance for the screws 135. Each circulator 115 may be fabricated on a two-layer substrate 215 (e.g., a non-conductive magnetic ceramic substrate), and may include two magnets 220 (one of which is, in the view of FIG. 2A, below the two-layer substrate 215, and not visible. The two magnetic layers of the two-layer magnetic substrate 215 may be metallized independently, then attached together with conductive material, then laser cut to size. Two magnetic layers may be used for a 4-port configuration (circulator on top and isolator on back side). In some embodiments, a single substrate layer may be used to form a 3-port configuration, having a circulator only. A 4-port configuration (circulator and isolator) may provide greater isolation than a 3-port configuration (circulator only) in the path that includes the isolator (transmit path or receive path). As the beam of an array antenna scans, the impedance may vary. This variation in impedance may lead to degradation in amplifier performance. The increased isolation obtained by using a 4-port circulator may substantially reduce the impedance variation at the amplifier. Some embodiments allow packaging of both 3-port and 4-port configurations.

At each of several of the interfaces, one or both of the surfaces abutting against each other at the interface may have a friction coating, e.g., a coating of nickel (or of nickel and aluminum, e.g., 95% Ni and 5% Al) applied by a plasma spray-coating process. For example, a friction coating may be applied to (i) the bottom surface of each cover strip 110 (i.e., the surface of the cover strip 110 that abuts against the top surface of the circulator carrier 120), (ii) the bottom surface of each circulator carrier 120 (i.e., the surface of the circulator carrier 120 that abuts against the top surface of the base plate 125), and (iii) the top surface of the translation plate 130 (i.e., the surface of the translation plate 130 that abuts against the bottom surface of the base plate 125). In some embodiment the clamping force provided by each fastener may be relatively low (e.g., 47 pounds, for a 00-90 screw at maximum allowable torque), and the friction coatings may avoid relative displacement of the parts at each of the interfaces at which a friction coating is present.

The base plate 125 may have a clearance hole 225 and the translation plate 130 may also have a clearance hole 230 for each of the coaxial interconnects 155, each of which may make contact with the two-layer substrate 215 of a corresponding 4-port circulator 115. The translation plate 130 may include (pressed into interference-fit holes in the translation plate 130) one or more alignment pins 235 each of which fits into a corresponding hole in the base plate 125. The base plate 125 may include (pressed into interference-fit holes in the base plate 125) one or more fine alignment pins 237 each of which fits through a corresponding hole in a circulator carrier 120 and into a corresponding hole in a cover strip 110.

Figure 2C:
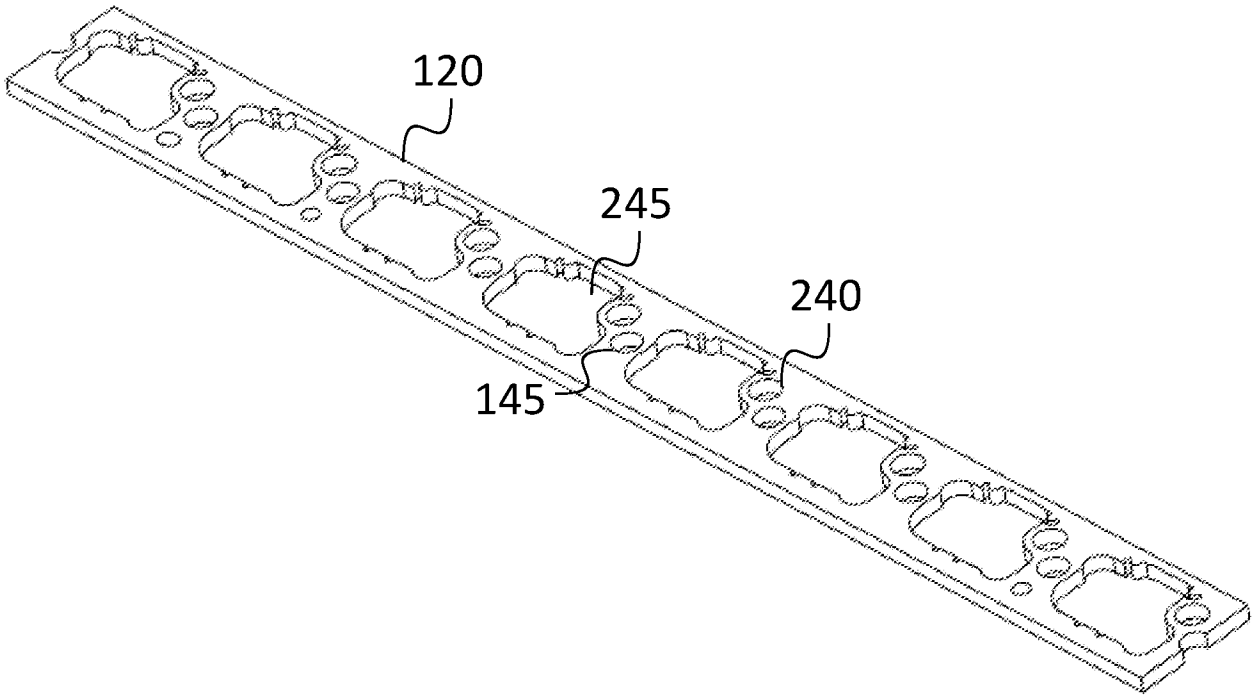
FIG. 2C is a perspective view of a portion of a circulator carrier, according to an embodiment of the present invention.

FIG. 2C shows a portion of a circulator carrier 120, in some embodiments. In addition to the clearance holes 145 mentioned above, the circulator carrier 120 includes a clearance hole 240, for each circulator 115, for one of the three coaxial interconnects 155 associated with the circulator 115. Each of a plurality of cutouts 245, of which there is one per circulator 115, provides clearance for one of the magnets 220 and for the other two coaxial interconnects 155 associated with the circulator 115. The clearance holes 145, 240 and the cutouts 245 may all have substantially vertical walls, so that the circulator carrier 120 may be fabricated with a relatively inexpensive wire EDM process (instead of, e.g., a more costly CNC milling process).

Figure 2D:
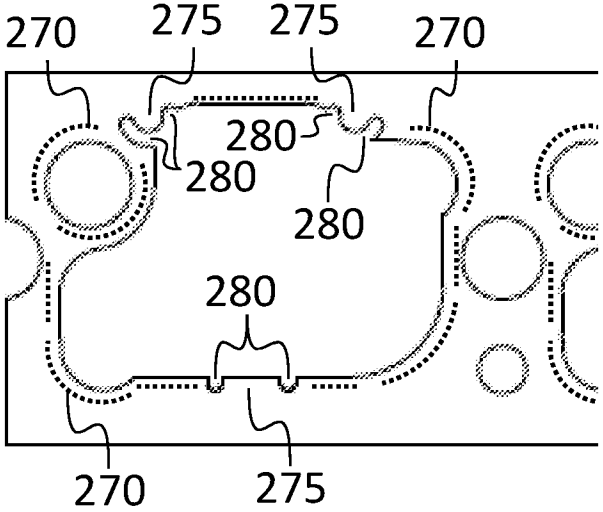
FIG. 2D is a top view of a portion of a circulator carrier, according to an embodiment of the present invention.

During assembly, each circulator 115 may initially be secured in place, or "staked" with UV-cured epoxy to prevent it, or other circulators on the circulator carrier 120, from being displaced during assembly, by magnetic forces between the circulators 115. For example, conductive epoxy 270 may be applied to the perimeter of one or more of the cutouts 245 (e.g., to the perimeter of each cutout 245 of the circulator carrier 120) as shown in FIG. 2D, and UV-curing epoxy may be applied at one or more (e.g., two, or three) "staking points" 275. Notch dams 280 (which may be notches, on the perimeter of a cutout 245, that act as dams) may be used to prevent the UV-curing epoxy and the conductive epoxy 270 from bleeding into each other. A circulator 115 may then be placed in its position on the circulator carrier 120, in a position at which UV-curing epoxy has been applied, and staked in place by illuminating the area with UV light, causing the UV-curing epoxy at the staking points 275 to cure. In some embodiments several circulators 115 are placed at once and all held in place while the UV-curing epoxy is caused to cure using UV light. This process may then be repeated for additional circulators 115 until all of the circulators 115 are installed on the circulator carrier 120; the conductive epoxy 270 may then be allowed (or caused) to cure.

Figure 2E:
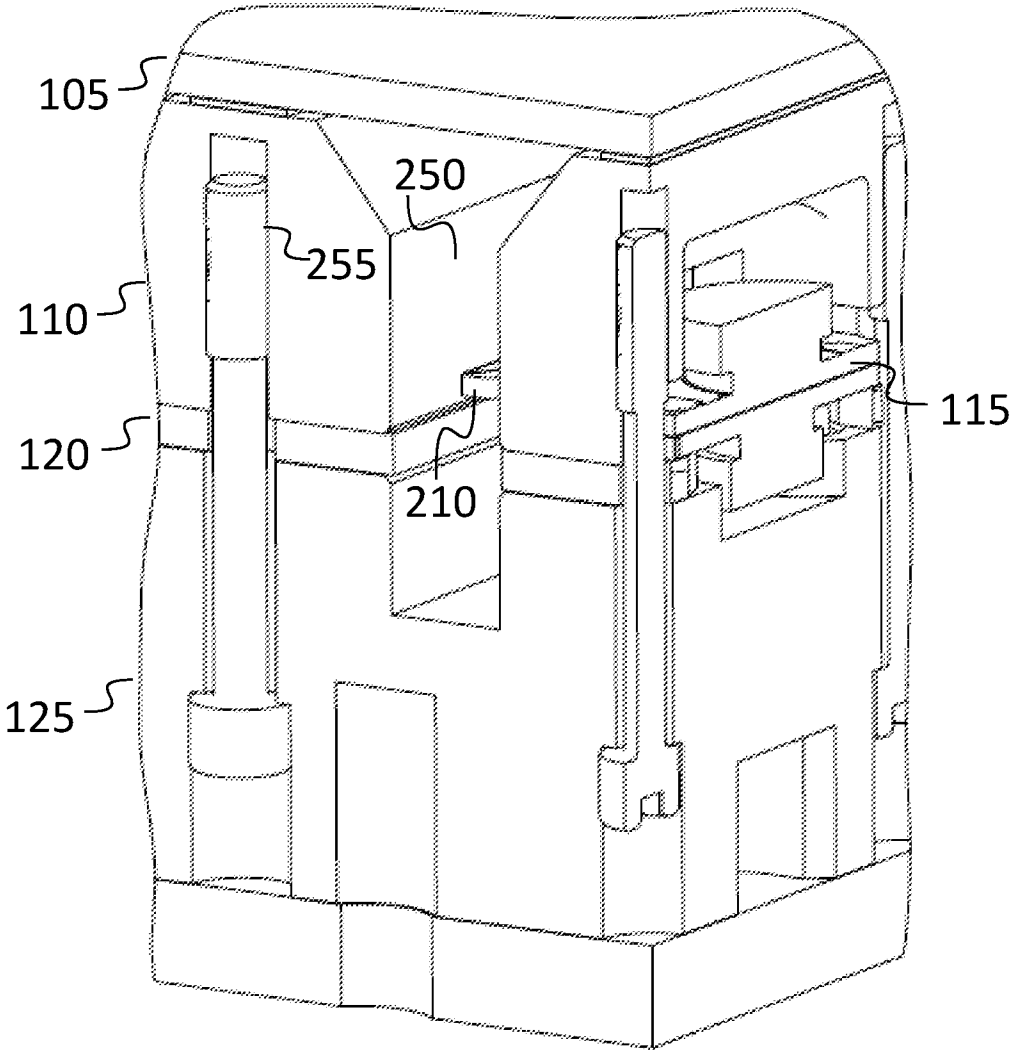
FIG. 2E is a cutaway perspective view of a portion of a compact long slot antenna, according to an embodiment of the present invention.

FIG. 2E shows a portion of an array antenna, in some embodiments. The base plate 125 includes a plurality of rectangular channels, and the walls of the circulator carrier 120 and of the cover strip 110 align with the walls of the channels to form slots 250 into which the integrated probes 210 of the circulators 115 extend, which span the width of the array, and which participate in the transformation between electromagnetic waves propagating in free space and guided waves propagating through the circulators 115. Each of the cover strips 110 may have two chamfered edges so that each slot flares at the top, as shown, which may aid in impedance transformation. Each of the threaded holes 150 in each cover strip 110 may be partially threaded, e.g., it may include a threaded portion 255 at the blind end of the hole, and be unthreaded below the threaded portion 255. Each of the screws 135 may have a shaft that is entirely threaded, or that is partially threaded as shown. In some embodiments, the pitch of the circulators on one of the slots (e.g., the spacing between adjacent circulators) may be 0.35 inches or less, and the pitch of the array may be comparable in the perpendicular direction (e.g., the spacing between adjacent channels (and, accordingly, the spacing between adjacent slots), may be 0.35 inches or less). In some embodiments, the pitch may be sufficiently fine for operation in the Ku band (i.e., between 12 GHz and 18 GHz).

For an acceptable match between the coefficient of thermal expansion of the two-layer magnetic substrates 215 and the coefficient of thermal expansion of the circulator carriers 120 (to facilitate a durable conductive epoxy bond that may be capable of surviving, e.g., 100, or 500, or more than 500 temperature cycles over the useful life of the array), the circulator carriers 120 may be composed of titanium. As used herein, "composed of" a material means comprising at least 80%, by weight, of the material, or, for a surface, comprising at least 80%, by surface area, of the material. Each circulator 115 (e.g., each two-layer substrate 215) may be secured to a corresponding circulator carrier 120 by a silver conductive epoxy bond. The surface of the circulator carrier 120 to which the circulator 115 is secured may be suitable for the formation of such a bond (e.g., it may be composed of aluminum or gold (and not of nickel, to which silver conductive epoxy may adhere poorly)). The translation plate 130, the base plate 125, and the cover strips 110 may all be composed of aluminum (e.g., 6061 aluminum or 7075 aluminum). In some embodiments the base plate 125 is composed of 7075 aluminum (e.g., 7075-T6 aluminum) (which has greater strength than 6061 aluminum) and the translation plate 130 and the cover strips 110 are composed of 6061 aluminum (e.g., 6061-T6 aluminum) (which is more readily machined that 7075 aluminum). As used herein, "aluminum" (except in the phrase "pure aluminum") means pure aluminum or any alloy containing at least 80% pure aluminum.

The surfaces of conductive parts that are in contact with each other (i) may be selected, plated, or otherwise coated or treated to be composed of materials with sufficiently similar anodic indices (e.g., anodic indices differing by less than 0.15 V) to avoid galvanic corrosion if moisture intrudes into the antenna, or (ii) any joints for which the anodic indices differ by more than 0.15 V may be sealed to avoid the intrusion of moisture. In one embodiment, this is accomplished by plating the cover strip 110 with aluminum, and forming the translation plate 130, the base plate 125, and the cover strips 110 of aluminum. Each aluminum surface may be chromate conversion coated. The joint between the silver conductive epoxy bond and the aluminum surface of the circulator carrier 120 may be sealed with a polymer conformal coating (e.g., with a parylene coating) to avoid the intrusion of moisture.

In another embodiment, each circulator carrier 120 may be nickel plated on (i) the surface that, in the completed assembly, is in contact with a corresponding surface of the base plate 125 and on (ii) the surface that, in the completed assembly, is in contact with a corresponding surface of a respective cover strip 110, and it may be gold plated over the remainder of its surface. The surfaces of the base plate 125 and of the cover strips 110 that, in the completed assembly, are in contact with a circulator carrier 120, may also be nickel plated, so that at each of the joints between a cover strip 110 and a circulator carrier 120, and at each of the joints between the base plate 125 and a circulator carrier 120, the materials on both sides of the joint are the same (i.e., nickel).

In this embodiment, the bottom surface of the base plate 125 and the top surface of the translation plate 130 may both be chromate conversion coated aluminum.

Figure 2F:
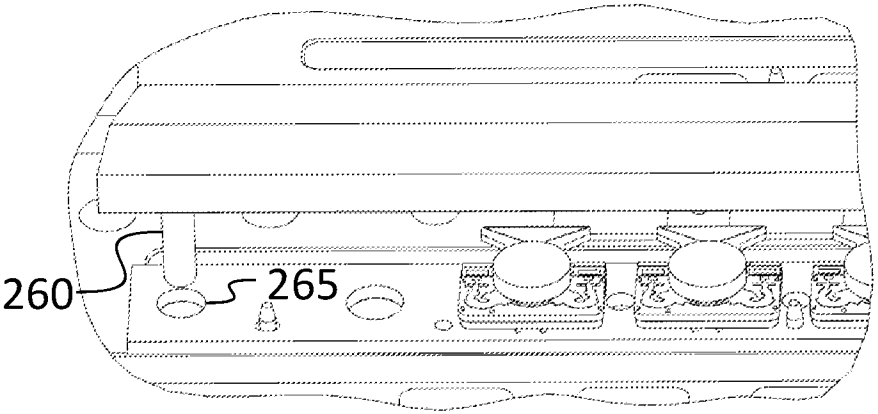
FIG. 2F is an exploded perspective view of a portion of a compact long slot antenna, according to an embodiment of the present invention.
Figure 2G:
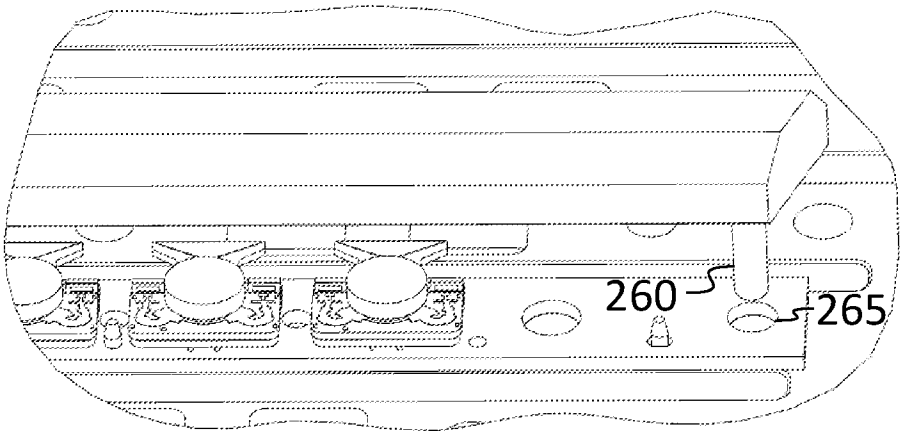
FIG. 2G is an exploded perspective view of a portion of a compact long slot antenna, according to an embodiment of the present invention.

Referring to FIGS. 2F and 2G, each cover strip 110 may include (pressed into interference-fit holes in the cover strip 110) one or more (e.g., two) coarse alignment pins 260, each of which may engage, during assembly, a clearance hole 265 in the circulator carrier 120 and a clearance hole in the base plate 125. The use of such coarse alignment pins, which may be significantly longer, e.g., longer by a factor of between 2 and 20, than the fine alignment pins 237, may facilitate initially aligning parts sufficiently precisely for the fine alignment pins 237 to engage their respective clearance holes. In some embodiments each of the clearance holes for the fine alignment pins 237 has an inside diameter exceeding the outside diameter of the fine alignment pins 237 by an amount between 0.0002 inches and 0.0006 inches. In some embodiments each of the clearance holes for the coarse alignment pins 260 has an inside diameter exceeding the outside diameter of the coarse alignment pins 260 by an amount between 0.040 inches and 0.080 inches, e.g., by 0.060 inches.

Figure 3A:
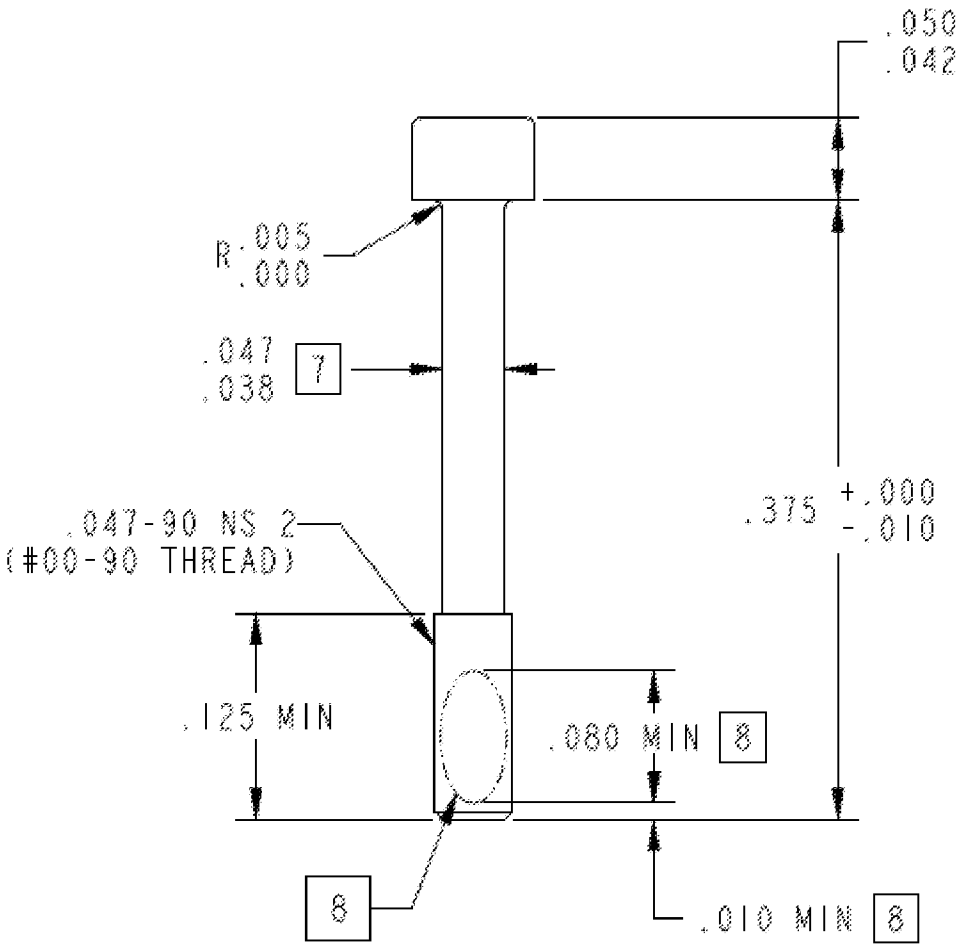
FIG. 3A is a side view of a threaded fastener, according to an embodiment of the present invention.
Figure 3B:
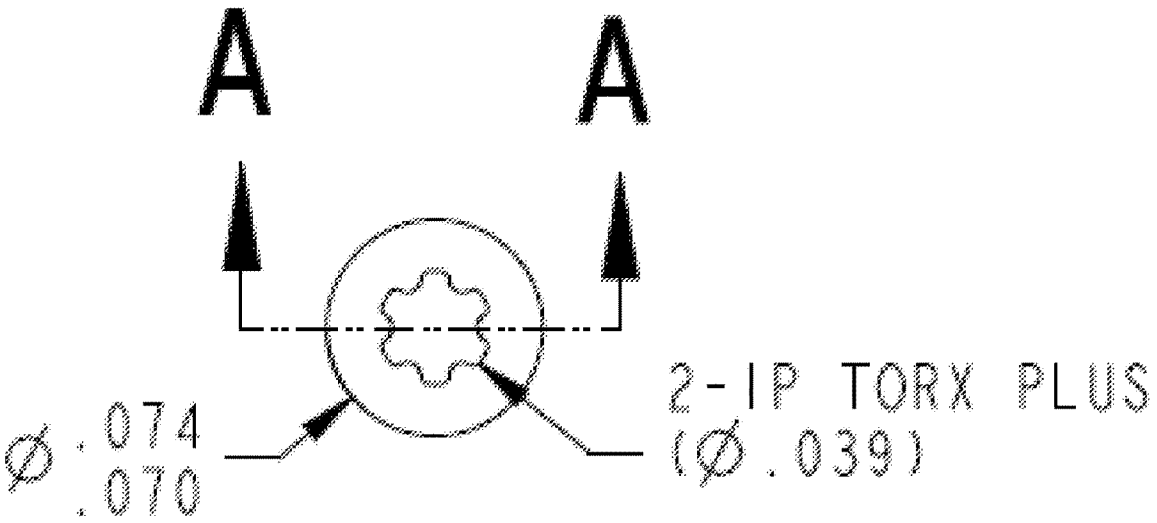
FIG. 3B is a top view of a threaded fastener, according to an embodiment of the present invention.
Figure 3C:
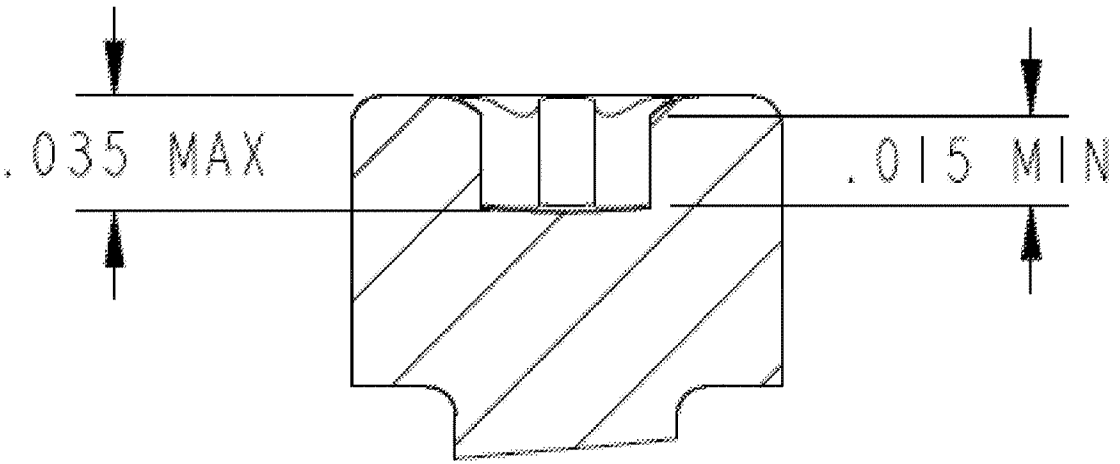
FIG. 3C is a side cross sectional view of a portion of a threaded fastener, according to an embodiment of the present invention.

Each of the screws 135 may be selected to have characteristics suitable for the task of securing the cover strips 110 and circulator carriers 120 to the base plate 125. For example, the screws may have a 00-90 UNS 3A thread form (and the threaded portions of the threaded holes 150 may have a 00-90 UNS 3B thread form). FIGS. 3A-3C are fabrication drawings that may be used to fabricate the screws 135. Each screw 135 may be composed of A286 stainless steel. The head of each screw may be a star-socket head with a smaller-than-standard outside diameter (e.g., 0.070 and 0.074 inches; the standard diameter for a 00-90 screw being 0.075 inches), and a star-shaped socket (e.g., a Torx-plus socket) for accommodating a suitable driver. The star-shaped socket may have a fallaway portion and a taller-than-standard vertical-walled portion (e.g., a vertical-walled portion having a height of at least 0.010 inches, e.g., 0.015 inches or more as shown in FIG. 3C; the standard height of the vertical-walled portion being as little as 0.007 inches). The increased height of the vertical-walled portion may allow the screw 135 to tolerate a greater tightening torque without stripping of the star-shaped socket. In some embodiments, each screw 135 is tightened, during assembly, to a torque between 12 inch-ounces and 14 inch-ounces. In some embodiments, each screw 135 is cadmium plated for lubricating the installation, and to serve as a sacrificial material to the galvanic couple to the aluminum female thread.

The use of threaded fasteners instead of bonded joints may result in an array antenna that is less vulnerable to damage from the combination of temperature changes and mismatches in coefficients of thermal expansion. Moreover, the use of threaded fasteners that pass through the base plate 125 from the rear, and that thread into threaded holes 150 in the cover strips 110 (instead of threaded fasteners that pass through the cover strips 110 from the front, and that thread into threaded holes 150 in the base plate 125) may (i) avoid costly rework that otherwise would be required if a threaded hole in the (costly) base plate 125 were to become damaged and (ii) make readily possible the removal of the wide-angle impedance matching sheet 105 (together with the cover strips 110). The use of threaded fasteners instead of bonded joints may decrease assembly time by eliminating oven cure cycles that may be employed when bonding. In addition, large arrays can easily be constructed from easily fabricated building blocks (for example 8 element or 16 element circulator strips and covers).

Although limited embodiments of a compact long slot antenna have been specifically described and illustrated herein, many modifications and variations will be apparent to those skilled in the art. Accordingly, it is to be understood that a compact long slot antenna employed according to principles of this invention may be embodied other than as specifically described herein. The invention is also defined in the following claims, and equivalents thereof.

What is claimed is:

1. An array antenna, comprising:

a base plate having a surface comprising a plurality of channels, a plurality of circulator carriers on the base plate, a plurality of cover strips on the circulator carriers, a plurality of circulators on the circulator carriers, and a plurality of threaded fasteners, the circulator carriers and the cover strips being secured to the base plate by the threaded fasteners, each of the circulators being coplanar with the base plate, the base plate having a first surface in conductive contact with a first surface of a first circulator carrier of the circulator carriers, the first surface of the base plate being composed of a first material having a first anodic index, the first surface of the first circulator carrier being composed of a second material having a second anodic index, wherein:

a first cover strip of the plurality of cover strips has a first surface in conductive contact with a second surface of the first circulator carrier;

the second surface of the first circulator carrier is composed of a third material having a third anodic index;

the first surface of the first cover strip is composed of a fourth material having a fourth anodic index, and wherein the first material, the second material, the third material, and the fourth material are the same.

2. The array antenna of claim 1, wherein each of the threaded fasteners is a stainless steel machine screw with a length of at least 0.300 inches and an outer thread diameter of at most 0.052 inches, and the array antenna is suitable for operation at 18 GHz.

3. The array antenna of claim 2, wherein:

a first one of the threaded fasteners has a star-socket head with a diameter of at most 0.074 inches, and the star-socket head has a star-shaped socket, the star-shaped socket having a vertical-walled portion and a fallaway portion, the vertical-walled portion having a height of at least 0.010 inches.

4. The array antenna of claim 2, wherein a first one of the threaded fasteners has a shaft having a threaded portion extending along at least one-quarter of the shaft, the threaded portion comprising thread-locking compound.

5. The array antenna of claim 1, wherein the base plate comprises a plurality of fine alignment pins extending through the first circulator carrier and into a first cover strip of the plurality of cover strips.

6. The array antenna of claim 5, wherein the first cover strip comprises a coarse alignment pin extending through the first circulator carrier and into the base plate.

7. The array antenna of claim 1, further comprising:

a translation plate, secured to the bottom of the base plate; and a printed wiring board, secured to the bottom of the translation plate, the printed wiring board comprising a plurality of microstrip transmission lines, the translation plate being conductive and having a plurality of channels each corresponding to a respective one of the plurality of microstrip transmission lines.

8. An array antenna, comprising:

a base plate having a surface comprising a plurality of channels, a plurality of circulator carriers on the base plate, a plurality of cover strips on the circulator carriers, a plurality of circulators on the circulator carriers, and a plurality of threaded fasteners, the circulator carriers and the cover strips being secured to the base plate by the threaded fasteners, each of the circulators being coplanar with the base plate, the base plate having a first surface in conductive contact with a first surface of a first circulator carrier of the circulator carriers, the first surface of the base plate being composed of a first material having a first anodic index, the first surface of the first circulator carrier being composed of a second material having a second anodic index, wherein the first circulator carrier has a plurality of notch dams configured to prevent a first epoxy applied at an edge of a cutout from bleeding into a second epoxy applied at the edge of the cutout.

9. The array antenna of claim 8, wherein:

a first cover strip of the plurality of cover strips has a first surface in conductive contact with a second surface of the first circulator carrier;

the second surface of the first circulator carrier is composed of a third material having a third anodic index;

the first surface of the first cover strip is composed of a fourth material having a fourth anodic index; and the third anodic index and the fourth anodic index differ by no more than 0.15 V.

10. The array antenna of claim 9 wherein the first material, the second material, the third material, and the fourth material are the same.

11. An array antenna, comprising:

a base plate having a surface comprising a plurality of channels, a plurality of circulator carriers on the base plate, a plurality of cover strips on the circulator carriers, a plurality of circulators on the circulator carriers, and a plurality of threaded fasteners, the circulator carriers and the cover strips being secured to the base plate by the threaded fasteners, each of the circulators being coplanar with the base plate, the base plate having a first surface in conductive contact with a first surface of a first circulator carrier of the circulator carriers, the first surface of the base plate being composed of a first material having a first anodic index, the first surface of the first circulator carrier being composed of a second material having a second anodic index, wherein the circulator carriers comprise at least 85% titanium, by weight.

12. The array antenna of claim 11, wherein the first circulator carrier comprises an outer surface plating, the outer surface plating being composed of aluminum or gold.

13. The array antenna of claim 12, wherein the base plate is composed of aluminum, and the first surface of the base plate is composed of chromate conversion coated aluminum.

14. The array antenna of claim 13, wherein the first cover strip is composed of aluminum, and the first surface of the first cover strip is composed of chromate conversion coated aluminum.

15. The array antenna of claim 14, wherein the base plate is composed of 7075 aluminum, and the first cover strip is composed of 6061 aluminum.

16. The array antenna of claim 14, wherein a first circulator of the plurality of circulators is secured to the first circulator carrier with silver conductive epoxy bond.

17. The array antenna of claim 16, wherein the silver conductive epoxy bond is sealed with a polymer conformal coating.

18. The array antenna of claim 11, wherein the first circulator carrier comprises:

a first outer surface plating on the first surface of the first circulator carrier, the first outer surface plating being composed of nickel;

a second outer surface plating on the second surface of the first circulator carrier, the second outer surface plating being composed of nickel; and a third outer surface plating on the remainder of the outer surface of the first circulator carrier, the third outer surface plating being composed of gold.

19. The array antenna of claim 18, wherein the base plate is composed of aluminum, and the first surface of the base plate is composed of nickel.

20. The array antenna of claim 19, wherein the first cover strip is composed of aluminum, and the first surface of the first cover strip is composed of nickel.

* * * * *